US005908232A

United States Patent [19]

Burns et al.

[11] Patent Number: 5,908,232

[45] Date of Patent: Jun. 1, 1999

[54] ILLUMINATABLE BAG

[76] Inventors: Mike O. Burns; Kenny Barton, both of Rte. 2 Box 248, Ardmore, Okla. 73401

[21] Appl. No.: 09/007,414

[22] Filed: Jan. 15, 1998

[51] Int. Cl.[6] ..... A45C 15/06

[52] U.S. Cl. ..... 362/156; 362/155; 362/191; 362/184

[58] Field of Search ..... 362/156, 154, 362/103, 184, 155

[56] References Cited

U.S. PATENT DOCUMENTS

| | | | |
|---|---|---|---|
| 2,003,130 | 5/1935 | Benjafield | 362/156 |
| 2,218,396 | 10/1940 | Hallbauer | 362/156 |
| 3,408,489 | 10/1968 | Boyer et al. | 362/156 |
| 3,609,341 | 9/1971 | Castaldo | 362/156 |
| 3,609,342 | 9/1971 | Wisniewski | 362/156 |
| 5,073,844 | 12/1991 | Coyner et al. | 362/156 |

*Primary Examiner*—Thomas M. Sember

[57] ABSTRACT

A new illuminatable bag for enabling a user to locate items disposed within the bag. The inventive device includes a bag portion having a hollow interior. The bag portion has a battery chamber formed therein. A pair of lights are secured within the hollow interior of bag portion. The pair of lights have wiring extending downwardly therefrom to couple with connectors of the battery chamber. Batteries are removably positioned within the battery chamber. The batteries communicate with the connectors of the battery chamber for powering the pair of lights.

6 Claims, 2 Drawing Sheets

ILLUMINATABLE BAG

BACKGROUND OF THE INVENTION

1. Field of the Invention

The present invention relates to purse lights and more particularly pertains to a new illuminatable bag for enabling a user to locate items disposed within the bag.

2. Description of the Prior Art

The use of purse lights is known in the prior art. More specifically, purse lights heretofore devised and utilized are known to consist basically of familiar, expected and obvious structural configurations, notwithstanding the myriad of designs encompassed by the crowded prior art which have been developed for the fulfillment of countless objectives and requirements.

Known prior art purse lights include U.S. Pat. No. 5,424,926 to Myers; U.S. Pat. No. 5,444,605 to Rivera; U.S. Pat. No. Des. 361,855 to Jones et al.; U.S. Pat. No. Des. 339,229 to Lopez; U.S. Pat. No. 5,005,111 to Teal; and U.S. Pat. No. 4,912,611 to Lyle.

While these devices fulfill their respective, particular objectives and requirements, the aforementioned patents do not disclose a new illuminatable bag. The inventive device includes a bag portion having a hollow interior. The bag portion has a battery chamber formed therein. A pair of lights are secured within the hollow interior of bag portion. The pair of lights have wiring extending downwardly therefrom to couple with connectors of the battery chamber. Batteries are removably positioned within the battery chamber. The batteries communicate with the connectors of the battery chamber for powering the pair of lights.

In these respects, the illuminatable bag according to the present invention substantially departs from the conventional concepts and designs of the prior art, and in so doing provides an apparatus primarily developed for the purpose of enabling a user to locate items disposed within the bag.

SUMMARY OF THE INVENTION

In view of the foregoing disadvantages inherent in the known types of purse lights now present in the prior art, the present invention provides a new illuminatable bag construction wherein the same can be utilized for enabling a user to locate items disposed within the bag.

The general purpose of the present invention, which will be described subsequently in greater detail, is to provide a new illuminatable bag apparatus and method which has many of the advantages of the purse lights mentioned heretofore and many novel features that result in a new illuminatable bag which is not anticipated, rendered obvious, suggested, or even implied by any of the prior art purse lights, either alone or in any combination thereof.

To attain this, the present invention generally comprises a bag portion defined by an open top, a closed bottom, opposed front and rear walls, and opposed side walls. The bag portion has a hollow interior. The open top has closure means incorporated therein. The bag portion has a carrying strap with free ends secured to the opposed side walls thereof. The closed bottom has a battery chamber formed therein. A pair of lights are secured to the opposed side walls of the bag portion disposed within the hollow interior. The pair of lights have wiring extending downwardly therefrom to couple with connectors of the battery chamber. Batteries are removably positioned within the battery chamber. The batteries communicate with the connectors of the battery chamber for powering the pair of lights. A switch is disposed within one of the opposed side walls of the bag portion. The switch is in communication with the pair of lights for selective activation and deactivation of the lights.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new illuminatable bag apparatus and method which has many of the advantages of the purse lights mentioned heretofore and many novel features that result in a new illuminatable bag which is not anticipated, rendered obvious, suggested, or even implied by any of the prior art purse lights, either alone or in any combination thereof.

It is another object of the present invention to provide a new illuminatable bag which may be easily and efficiently manufactured and marketed.

It is a further object of the present invention to provide a new illuminatable bag which is of a durable and reliable construction.

An even further object of the present invention is to provide a new illuminatable bag which is susceptible of a low cost of manufacture with regard to both materials and labor, and which accordingly is then susceptible of low prices of sale to the consuming public, thereby making such illuminatable bag economically available to the buying public.

Still yet another object of the present invention is to provide a new illuminatable bag which provides in the apparatuses and methods of the prior art some of the advantages thereof, while simultaneously overcoming some of the disadvantages normally associated therewith.

Still another object of the present invention is to provide a new illuminatable bag for enabling a user to locate items disposed within the bag.

Yet another object of the present invention is to provide a new illuminatable bag which includes a bag portion having a hollow interior. The bag portion has a battery chamber formed therein. A pair of lights are secured within the hollow interior of bag portion. The pair of lights have wiring extending downwardly therefrom to couple with connectors of the battery chamber. Batteries are removably positioned within the battery chamber. The batteries communicate with the connectors of the battery chamber for powering the pair of lights.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
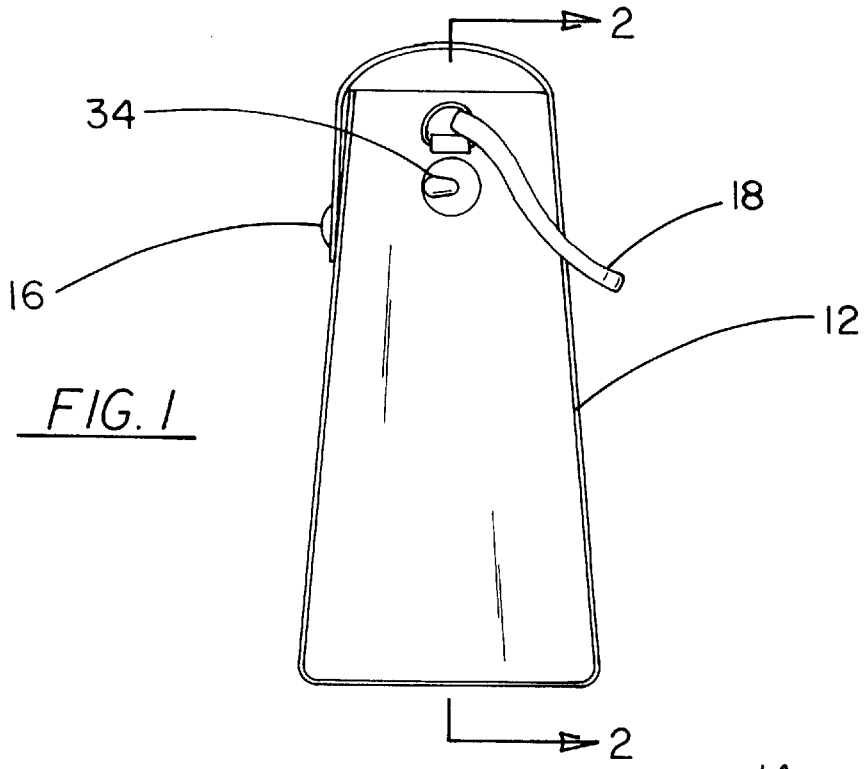
FIG. 1 is a side view of a new illuminatable bag according to the present invention.
Figure 2:
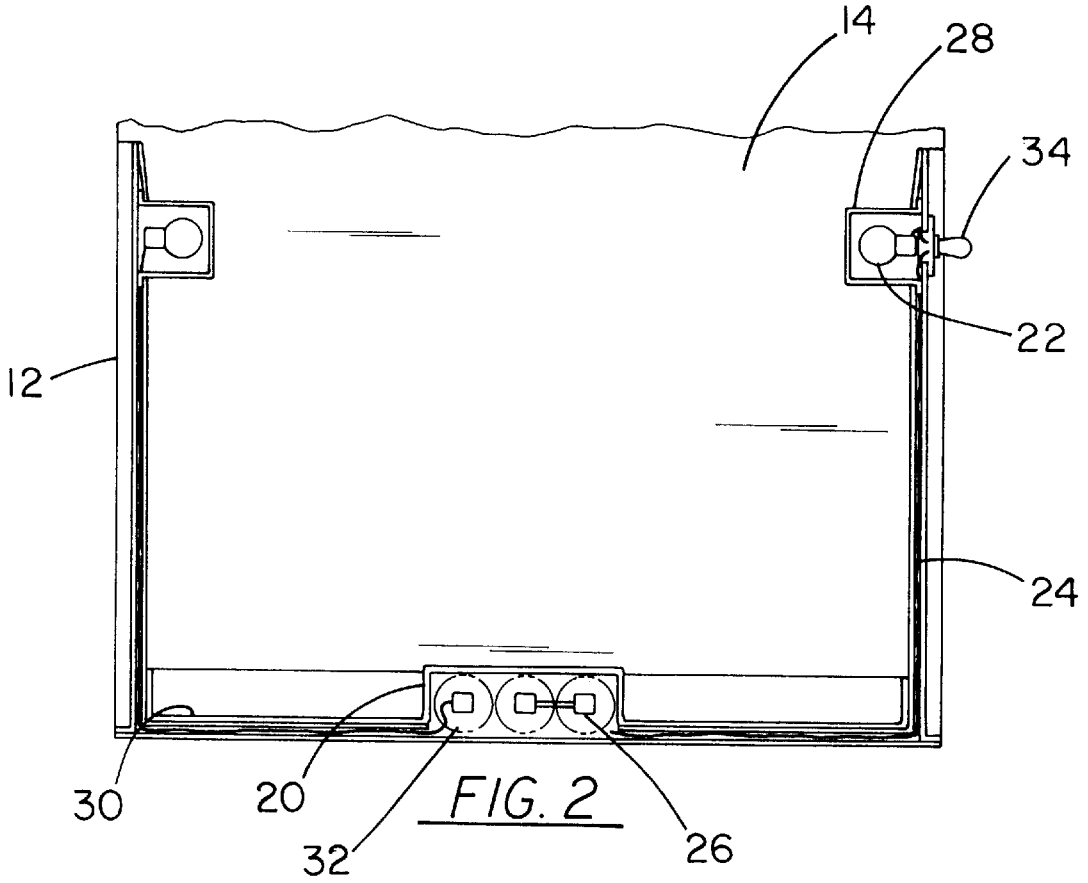
FIG. 2 is a cross-sectional view of the present invention as taken along line 2—2 of FIG. 1.
Figure 3:
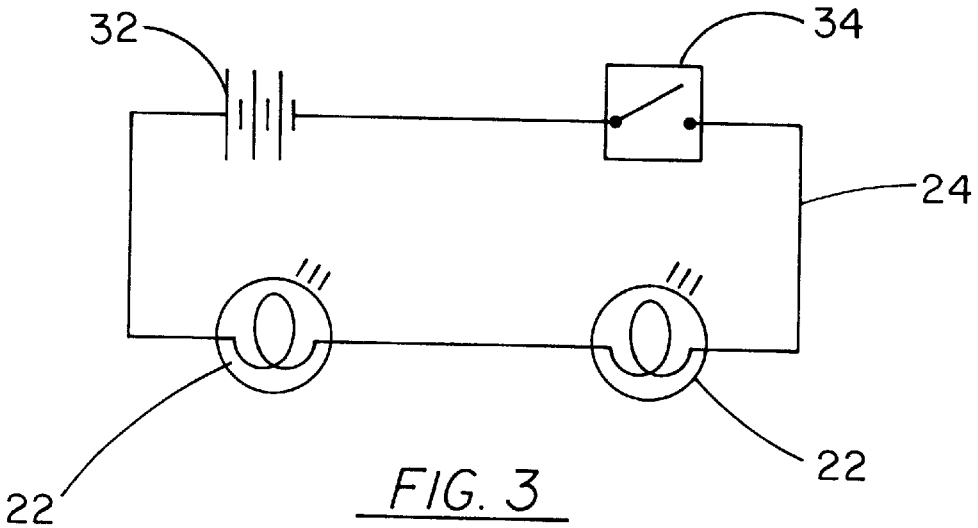
FIG. 3 is a schematic illustration of the present invention.
Figure 4:
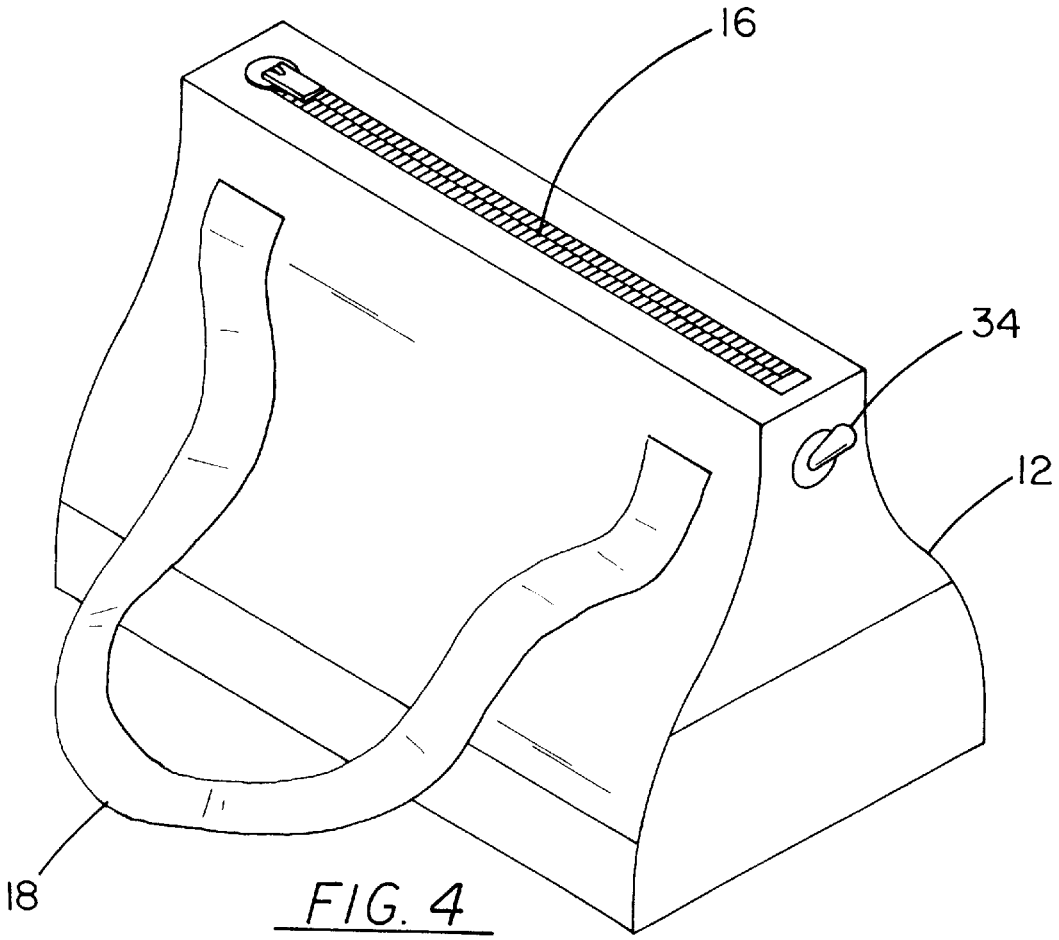
FIG. 4 is a perspective view of an alternate bag of the present invention.

With reference now to the drawings, and in particular to FIGS. 1 through 4 thereof, a new illuminatable bag embodying the principles and concepts of the present invention and generally designated by the reference numeral 10 will be described.

As best illustrated in FIGS. 1 through 4, the illuminatable bag 10 comprises a bag portion 12 defined by an open top, a closed bottom, opposed front and rear walls, and opposed side walls. The bag portion 12 has a hollow interior 14. The open top has closure means 16 incorporated therein. The bag portion 12 has a carrying strap 18 with free ends secured to the opposed side walls thereof. The closed bottom has a battery chamber 20 formed therein. The bag portion 12 could be made in any type of configuration to meet any need. The closure means 16 employed could be a zipper, snaps or other type.

A pair of lights 22 are secured to the opposed side walls of the bag portion 12 disposed within the hollow interior 14. The pair of lights 22 have wiring 24 extending downwardly therefrom to couple with connectors 26 of the battery chamber 20. The pair of lights 22 would be surrounded by plastic lenses 28 which would ensure that they remained in place while also protecting the lights 22. The wiring 24 would be concealed beneath a vinyl or plastic covering 30 so as not to detract from the bag portion 12.

Batteries 32 are removably positioned within the battery chamber 20. The batteries 32 communicate with the connectors 26 of the battery chamber 20 for powering the pair of lights 22.

A switch 34 is disposed within one of the opposed side walls of the bag portion 12. The switch 34 is in communication with the pair of lights 22 for selective activation and deactivation of the lights 22.

In use, the user could simply activate the pair of lights 22 by activating the switch 34. The illuminated lights 22 would enable the user to quickly locate items such as keys, money, a bus pass, a pen, a diaper, pacifier, etc. The lights 22 would eliminate the hassle and frustration of removing all of the items in the bag portion 12 to find one item.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An illuminatable bag for enabling a user to locate items disposed within the bag comprising, in combination:

a bag portion defined by an open top, a closed bottom, opposed front and rear walls, and opposed side walls, the bag portion having a hollow interior, the open top having closure means incorporated therein, the bag portion having a carrying strap with free ends secured to the opposed side walls thereof, the closed bottom having a battery chamber formed therein;

a pair of lights a first one of the pair of lights being coupled to an upper portion of one of the opposed side walls of the bag portion and a second one of the pair of lights being coupled to an upper portion of the other opposed side wall such that the pair of lights are positioned to illuminate the hollow interior from opposite ends of the hollow interior for preventing blockage of illumination to a portion of the hollow interior by contents being held within the hollow interior, the pair of lights having wiring extending downwardly therefrom to couple with connectors of the battery chamber;

batteries removably positioned within the battery chamber, the batteries communicating with the connectors of the battery chamber for powering the pair of lights; and a switch disposed within one of the opposed side walls of the bag portion, the switch being in communication with the pair of lights for selective activation and deactivation of the lights.

2. An illuminatable bag for enabling a user to locate items disposed within the bag comprising, in combination:

a bag portion having a hollow interior with a pair of opposed side, the bag portion having a battery chamber formed therein;

a pair of lights, a first one of the pair of lights being coupled to an upper portion of one of the pair of opposed side walls of the bag portion and a second one of the pair of lights being coupled to an upper portion of another of the pair of opposed side wall such that the pair of lights are positioned to illuminate the hollow interior of the bag portion from opposite ends of the hollow interior for preventing blockage of illumination to a portion of the hollow interior by contents being held within the hollow interior, the pair of lights having wiring extending downwardly therefrom to couple with connectors of the battery chamber; and batteries removably positioned within the battery chamber, the batteries communicating with the connectors of the battery chamber for powering the pair of lights.

3. The illuminatable bag as set forth in claim 2 and further including a switch positioned within the bag portion, the switch being in communication with the pair of lights for selective activation and deactivation of the lights.

4. The illuminatable bag as set forth in claim 2 wherein the bag portion is defined by an open top, a closed bottom, and opposed front and rear walls extending between the pair of opposed side walls.

5. The illuminatable bag as set forth in claim 4 wherein the open top has closure means incorporated therein.

6. The illuminatable bag as set forth in claim 4 wherein the bag portion has a carrying strap with free ends secured to the opposed side walls thereof.

* * * * *